US006089785A

United States Patent [19]

Bergman

[11] Patent Number: 6,089,785

[45] Date of Patent: Jul. 18, 2000

[54] ROAD SERVICE ATTACHMENT FOR DUMP-TRUCK

[76] Inventor: Douglas Jerome Bergman, 43 Lorainne Drive, Linwood, Ontario, Canada, N0B 2A2

[21] Appl. No.: 09/151,876

[22] Filed: Sep. 11, 1998

[30] Foreign Application Priority Data

Sep. 10, 1997 [CA] Canada ..... 2215119

[51] Int. Cl.[7] ..... E01C 19/12

[52] U.S. Cl. ..... 404/101; 404/103; 404/105; 404/110

[58] Field of Search ..... 404/101, 104, 404/107, 108, 110, 96, 85, 86, 91, 92

[56] References Cited

U.S. PATENT DOCUMENTS

| | | | |
|---|---|---|---|
| 2,089,094 | 11/1937 | Kime . | |
| 2,197,878 | 7/1940 | Robinson . | |
| 2,762,276 | 9/1956 | Mauch | 404/110 |
| 2,839,975 | 6/1958 | Robinson | 94/44 |
| 2,914,995 | 12/1959 | Odell | 94/46 |
| 3,230,845 | 1/1966 | Mauldin | 404/110 |
| 3,456,566 | 7/1969 | Lazaro | 94/44 |
| 3,877,830 | 4/1975 | James, III | 404/84 |
| 4,215,949 | 8/1980 | Gabriel, Jr. | 404/110 |
| 4,492,490 | 1/1985 | Christine et al. | 404/108 |
| 4,571,119 | 2/1986 | Jones et al. | 404/110 |
| 4,767,234 | 8/1988 | Rizzo | 404/111 |
| 4,900,185 | 2/1990 | Foertsch | 404/104 |
| 4,954,010 | 9/1990 | Montgomery et al. | 404/96 |
| 5,484,229 | 1/1996 | Reece | 404/110 |

*Primary Examiner*—Thomas B. Will
*Assistant Examiner*—Raymond W Addie
*Attorney, Agent, or Firm*—Anthony Asquith & Co.

[57] ABSTRACT

A box of the attachment apparatus receives asphalt from the discharge chute of a forward-tip dump-truck. The asphalt is deposited on the rod in a stripe, and is compacted by being rolled over by the rear wheel of the truck. The thickness of the stripe is set by side-runners, which hold the bottom of the box clear of the road. The weight of the asphalt-laden box loads the side-runners against the road, and permits pre-compaction, in which the stripe of asphalt is partly pre-compacted before being rolled over by the wheel. Where the truck has double rear wheels, the stripe can be as wide as the width of both wheels. The box is carried on a parallelogram linkage, which is mounted from the chassis of the truck.

18 Claims, 5 Drawing Sheets

ROAD SERVICE ATTACHMENT FOR DUMP-TRUCK

This invention relates to an apparatus comprising an attached accessory to a truck, especially a front-discharge dump-truck. The apparatus receives hot- or cold-mix asphalt or other road-repair material from a storage box on the truck. The function of the apparatus is to control and effect the transfer of the asphalt onto the road surface. More particularly, the invention is concerned with laying a stripe of asphalt lengthways along an already-surfaced road, for repair purposes.

THE INVENTION IN RELATION TO THE PRIOR ART

Truck attachment devices are known (e.g. U.S. Pat. No. 4,571,119, JONES, February 1986), which function by depositing asphalt just in front of the rear road-wheel of the truck, whereby the road-wheel acts to compress and compact the just-deposited layer of asphalt. The present invention is aimed at retaining this advantageous feature.

However, previous designs in which the road-wheel compacts the just-deposited stripe have had the problem that the width of the stripe of asphalt had to be less than the width of the tire.

Other prior art (e.g. U.S. Pat. No. 3,456,566, LAZARO, July 1969) shows roadmaking machines in which a stripe of asphalt is laid across the full width of a carriageway of the road. A full-width roadmaking machine should be distinguished from a relatively narrow-stripe road-patching attachment, which is the subject of the present invention. Another prior art structure is a levelling sled shown in U.S. Pat. No. 5,484,229, REECE, January 1996).

GENERAL FEATURES OF THE INVENTION

In the invention, the apparatus comprises a means for laying a stripe of the repair material on the road surface, the stripe being positioned in line with a rear wheel of the truck, whereby the rear wheel rolls over the stripe, and compacts the material. The apparatus includes a box, for containing the road-repair-material, and includes a means for mounting and positioning the box on the truck under the side-chute, for receiving material from the side-chute.

The apparatus includes a laterally-extending stripe-thickness-setting blade, and left and right side-runners, which are positioned in the apparatus adjacent to the left and right lateral ends of the blade, respectively. In the apparatus, the side-runners comprise a means for supporting the weight of the box.

The apparatus includes a means for holding the stripe-thickness-setting-blade a height H clear of the road surface.

The box has a floor-surface, being the upward-facing surface against which rests the weight of the repair-material in the box. The box is provided with a deposition-aperture, which is so arranged in the apparatus as to discharge material therethrough from the box onto the road surface. The deposition-aperture occupies only a minor proportion of the floor-surface of the box, whereby most of the weight of the repair-material in the box acts on the box, weighting the box against the road surface.

In the apparatus, the deposition-aperture is positioned ahead of the blade, and the apparatus is so arranged that the blade passes over the material deposited from the aperture, and the thickness of the deposited stripe is defined by the height H at which the blade is held above the road surface.

DETAILED DESCRIPTION OF PREFERRED EMBODIMENTS

By way of further explanation of the invention, exemplary embodiments of the invention will now be described with reference to the accompanying drawings, in which.

The apparatuses shown in the accompanying drawings and described below are examples which embody the invention. It should be noted that the scope of the invention is defined by the accompanying claims, and not necessarily by specific features of exemplary embodiments.

Figure 1:
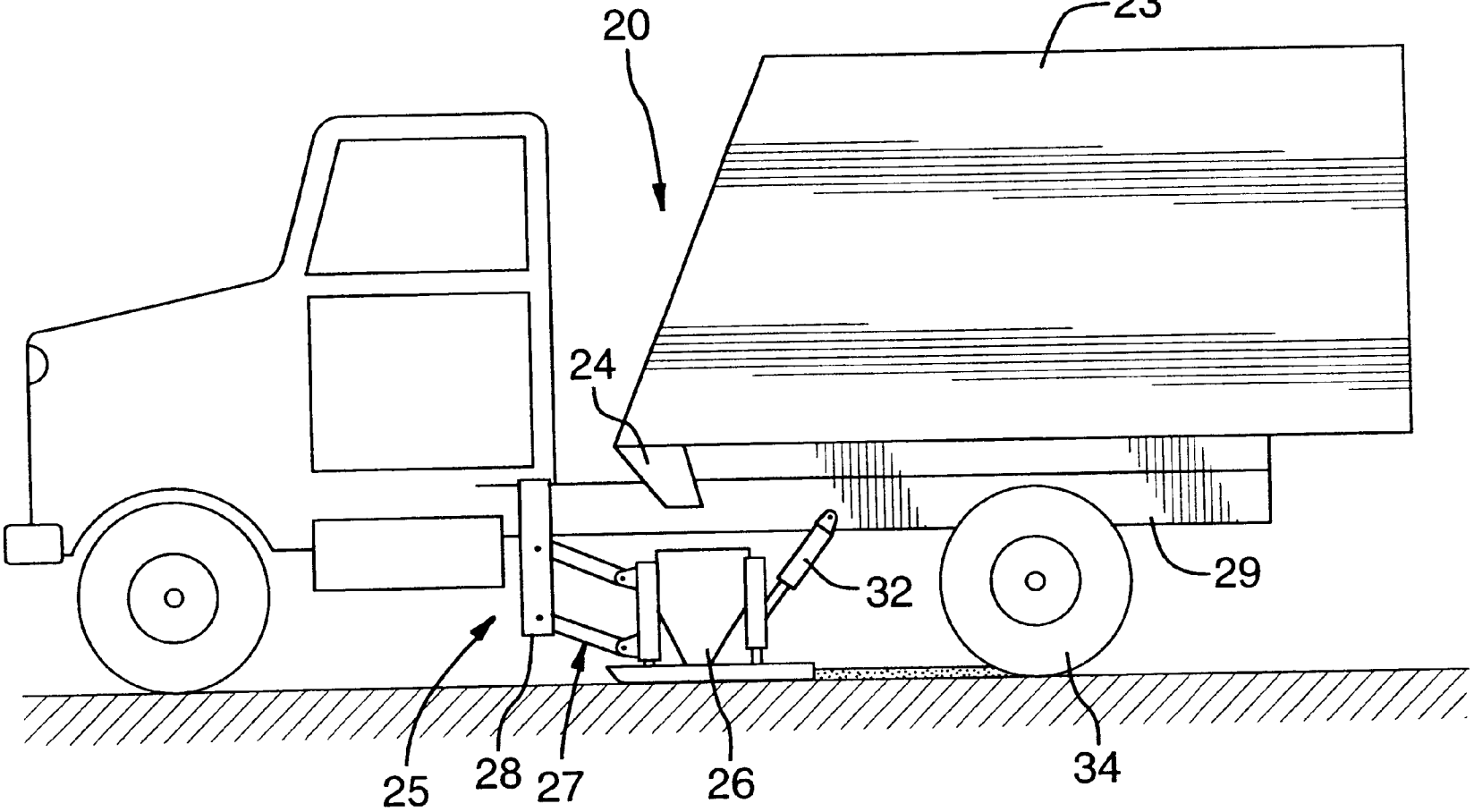
FIG. 1 is a side view of a dump-truck, on which is carried a road repair apparatus that embodies the invention.

FIG. 1 shows a dump-truck 20, having a hopper 23 for carrying a quantity of road-repair material, such as asphalt. The truck is of the type in which the contents of the hopper are caused to fall into a chute 24. Such trucks are in common usage; often, the truck is purchased for the purpose of applying sand and salt to icy roads in winter, and the truck serves also to deliver road-patching materials, in the summer. The truck is equipped with a control (not shown) whereby the driver can regulate the flow of material from the hopper 23 into the chute 24.

The apparatus 25 with which the invention is concerned is located under the truck 20. The apparatus includes a box 26. The box is carried on a linkage 27, which links the box to a support frame 28. The support frame 28 is attached (e.g. by welding, or bolting) to a main member 29 of the chassis of the truck 20. (The manner of attachment of the support-frame 28 is detailed in FIG. 5.)

The box 26 is adapted to be raised and lowered by means of a hydraulic ram 32. The top end of the ram is attached to the chassis member 29. The linkage 27 is of parallelogram form, which keeps the box upright during raising and lowering.

When the box 26 lies in the operational "down" position, the weight of the box rests on the road surface. The box is raised to the "up" position for stowage for non-operational transport.

The apparatus 25 is so located under the truck 20 as to be in line with the rear wheel 34 of the truck. Thus, as the truck moves (slowly) forwards, in operation of the apparatus, the rear wheel rolls over, and compresses, the just-deposited stripe of asphalt.

Figure 2:
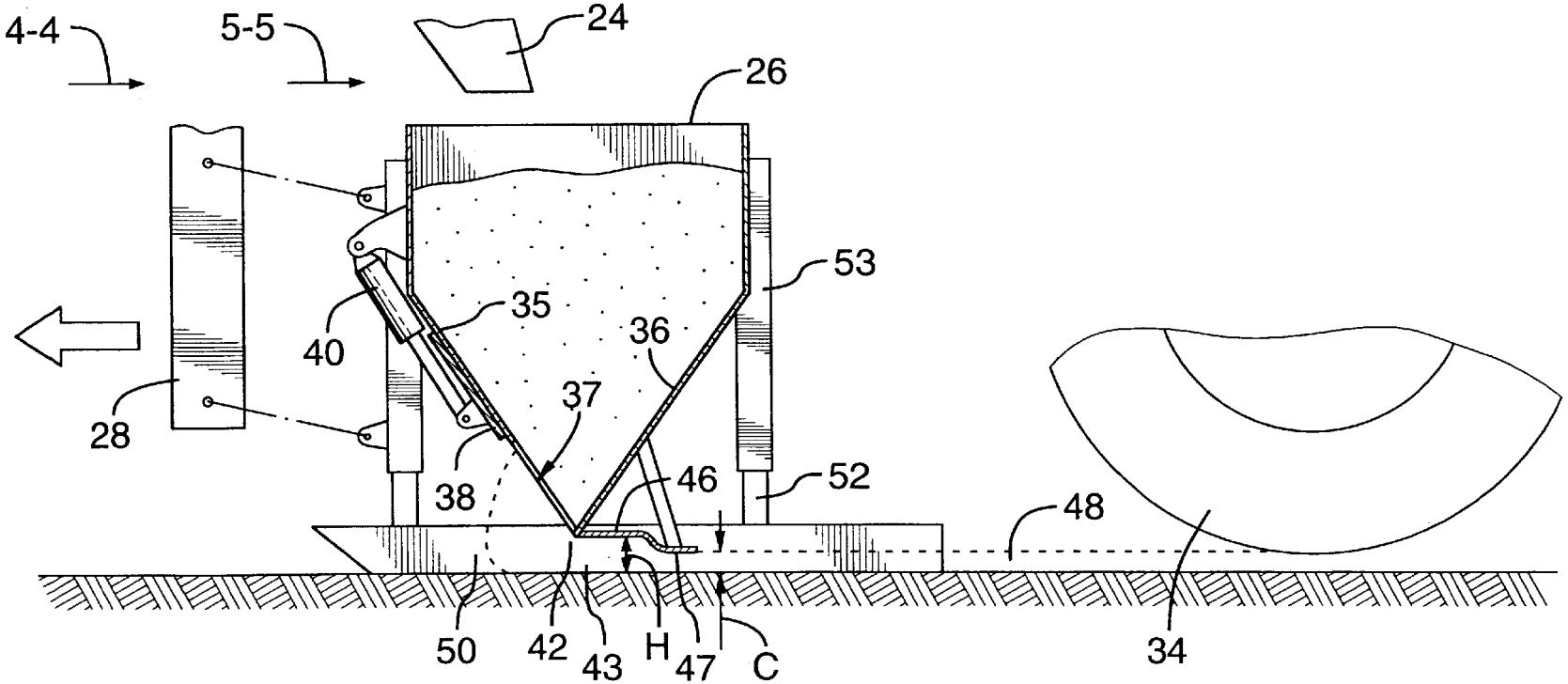
FIG. 2 is a close-up of a portion of FIG. 2, showing the road repair apparatus in more detail.

The apparatus is shown in more detail in FIG. 2. The box 26 is V-shaped, having a front panel 35 and a rear panel 36. The front panel 35 has a discharge aperture 37. A door 38 runs in side-guides 39, under the action of a ram 40, to open and close the aperture 37.

When the discharge aperture 37 is open, asphalt falls out of the aperture, and is deposited onto the road surface. The height or thickness of the deposited layer is determined by the distance H that the bottom edge 42 of the rear panel 36 lies above the road surface. It will be understood that bottom edge 42 scrapes the asphalt layer 43 to that thickness, and thereby serves as a stripe-thickness-setting blade.

Figure 3:
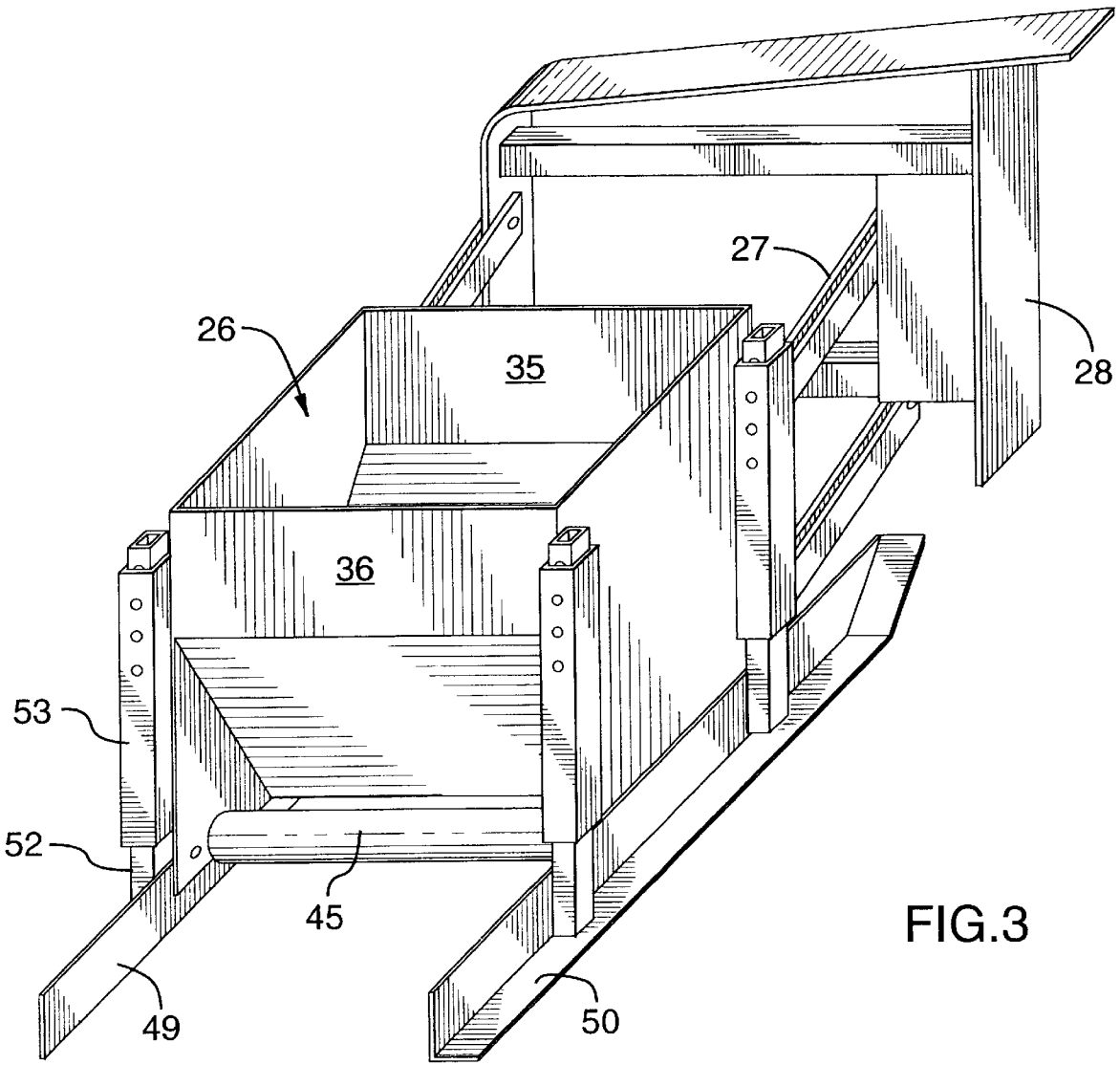
FIG. 3 is a pictorial view of the apparatus, seen from the rear.

The asphalt in the deposited layer 43 that is left behind as the truck moves forwards is not yet consolidated or compacted. The layer or stripe is pre-compacted by the action of a pre-compaction member, which is located behind the bottom edge 42. The pre-compaction member is shown in FIG. 3 in the form of a roller 45, but in FIG. 2 the pre-compaction member is shown as a shaped plate 46, which extends laterally across the width of the layer. The pre-compaction member protrudes below the bottom edge 42; that is to say, the bottom surface 47 of the shaped plate 46 is a height C above the road surface, and C is smaller than H. Thus the asphalt in the deposited stripe 43 is pre-compacted from a thickness H to a thickness C. (The pre-compacted stripe 48 will become more completely compacted by the action of the tire in rolling over the stripe.)

The height H of the bottom edge 42 of the box is adjusted by adjusting the height of left and right side-runners 49,50. The side runners are welded to upright posts 52, which run in tubes 53 welded to the box 26. Holes in the posts are pitched differently from holes 54 in the tubes, whereby the heights of the side-runners can be adjusted finely relative to the box.

The weight of the box 26, and of the asphalt contained in the box, acts on the floor of the box and is thereby transferred to the side-runners 49,50. Thus, the side-runners are pressed heavily against the road surface. The heavy weight resists a tendency of the box to "ride up" over the just-deposited asphalt material; rather, it has been found that the thickness of the stripe of deposited asphalt remains constant along the length of the stripe, the thickness being determined by the relative heights of the side-runners relative to the bottom edge 42 of the box.

Also, it is because the weight of the asphalt-laden box pressing down on the side-runners is so heavy that the pre-compaction of the stripe can be undertaken.

Figure 4:
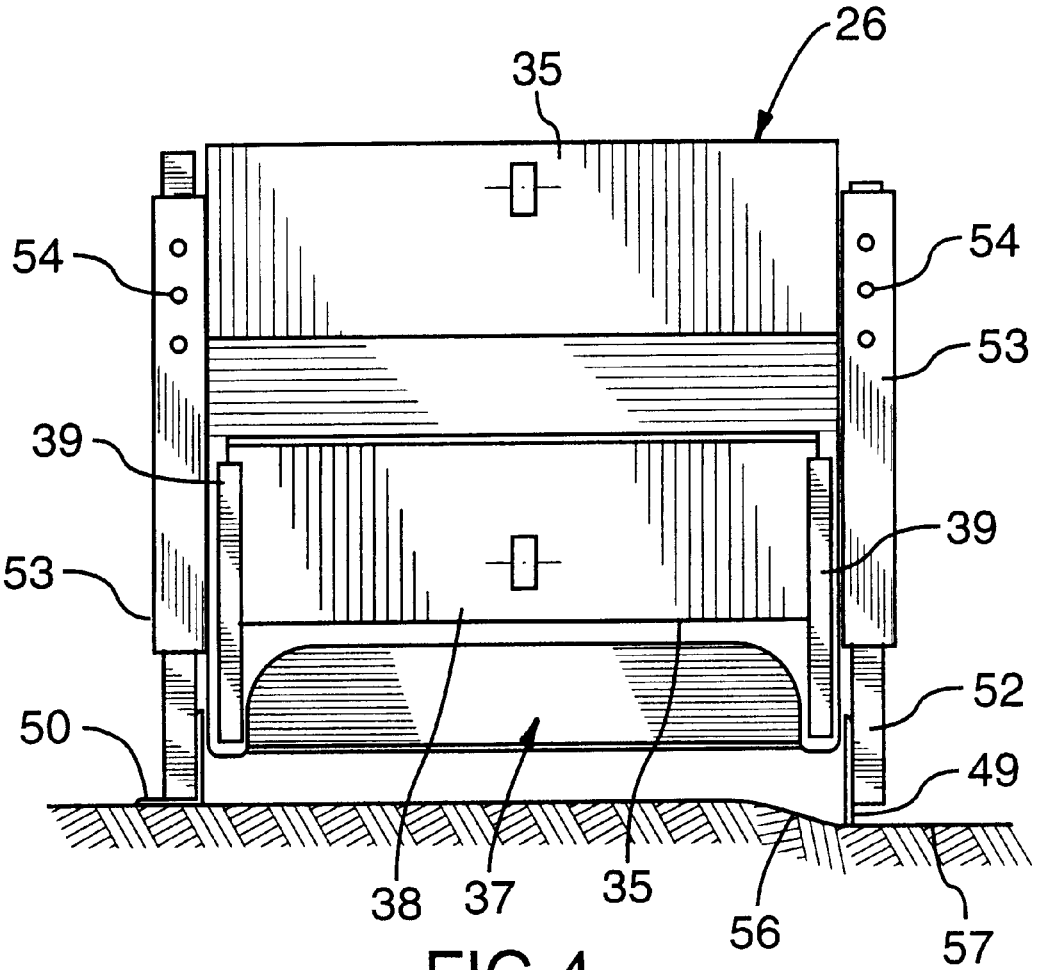
FIG. 4 is a view from the front of the apparatus on arrow 4—4 of FIG. 2.

As shown in FIG. 4, the stripe can be laid to follow the crown or slope of the road. Generally, it is the very edge 56 of the asphalt that deteriorates most, in cases where there is no kerb to the road but rather the asphalt is bordered by a gravel verge 57. Over time, the gravel recedes, leaving the edge 56 of the asphalt exposed and vulnerable to damage. It often happens that the usable surface of the road can shrink a little in width. In that case, it is important to ensure that the asphalt overlays a little beyond the damaged asphalt, to restore the full width of the road. In this case, the side-runner 49 runs on the gravel of the verge 57, as shown. The other side-runner 50 runs on the relatively undamaged area of the asphalt, nearer the centre of the road.

The linkage 27 has some twist-compliance, whereby the box is enabled to lie at a slight angle to the vertical, the angle being dictated by the angle of the crown of the road.

Figure 5:
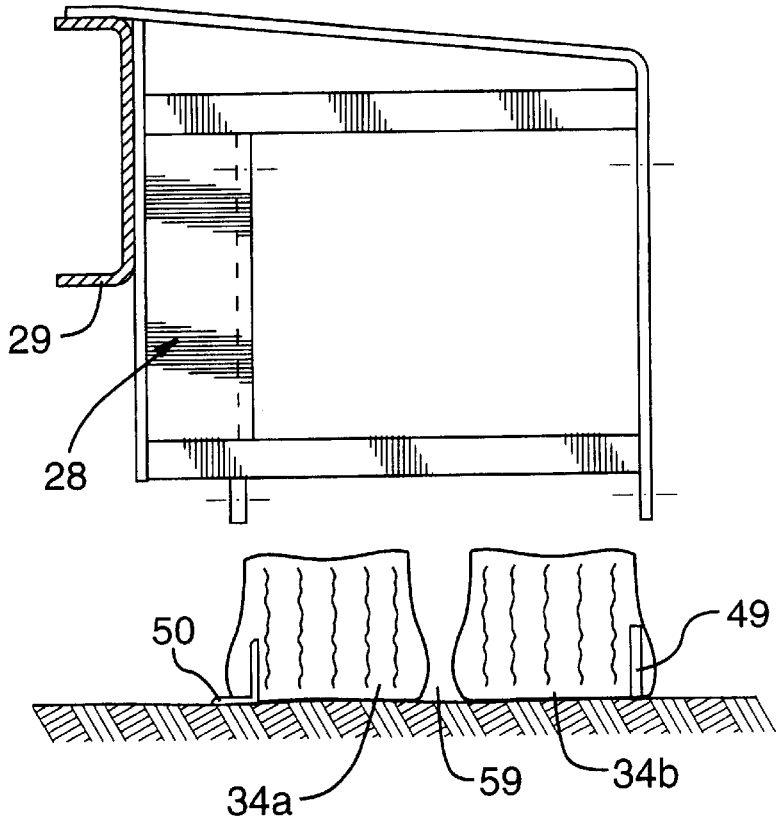
FIG. 5 is a view from the front of the apparatus on arrow 5—5 of FIG. 2.

Dump trucks of the type with which the described apparatus is used, have two rear wheels 34*a*,34*b* side by side, with a gap 59 between (FIG. 5). For proper compaction of the stripe, the width of the stripe of deposited asphalt preferably should not exceed the overall width of the two wheels. However, that still leaves the gap 59; that is to say, the portion of the stripe that lies in the gap 59 will not be compacted by the rear wheels.

It is recognised that the pre-compaction, as described, ensures that portion is at least pre-compacted, and it has been found that the portion, though it protrudes slightly above the surrounding height of the stripe immediately after compaction by the wheels, in fact quickly settles to a level height, which is acceptable in that asphalt has the property that its surface levels and smooths itself, especially over a period of time supporting traffic; however, without the pre-compaction, the ridge left by the gap 59 might sometimes be a disadvantageous. Smoothing such a ridge out by pre-compaction is not essential, however: if the road is being patched with hot-mix asphalt, it will be the common practice that the deposited asphalt will need heavy rolling in any event, which will smooth the ridge out; if the road is being patched with cold-mix asphalt, the ridge in the stripe can be smoothed out by backing up the truck, and driving a wheel over the ridge.

Sometimes, it is desirable for the repair to be wider than the width of the two rear wheels 34*a*,34*b* of the truck. In that case, a first stripe is laid, and then the truck is backed up, and a second stripe is laid alongside. The left-side-runner 49 (i.e left as viewed in the forward direction of the truck—FIG. 4 is a view looking backwards) is narrow, whereas the right-side-runner 50 is wide. The wide right-side-runner 50 is the side-runner that lies nearer the centre of the road.

Figure 6:
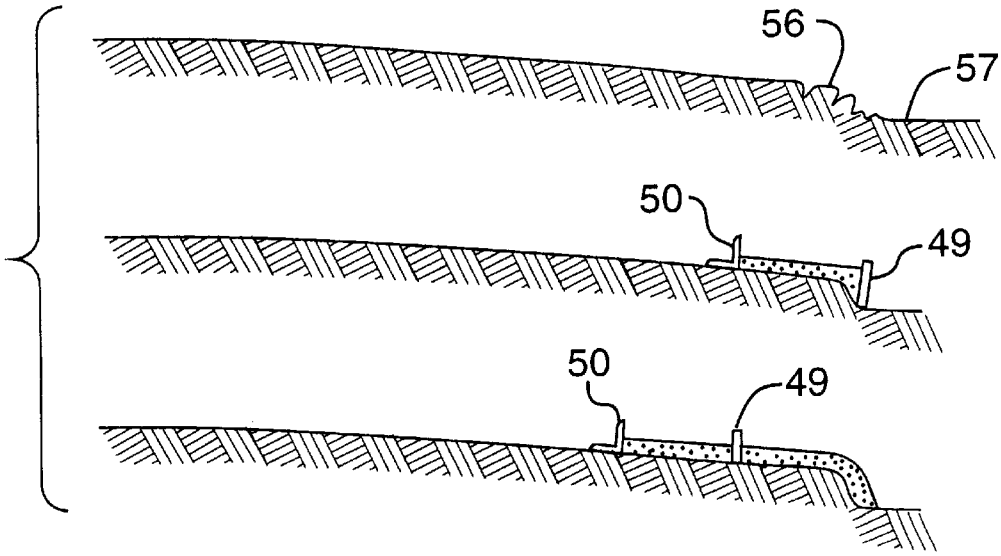
FIG. 6 is a view of two stripes of asphalt laid side by side on the edge of a road.

As shown in FIG. 6, when the second stripe is laid, the second stripe is separated from the first stripe only by the narrow thickness of the narrow side-runner 49, and such a narrow gap between the stripes will immediately be filled as the second stripe is compacted. A wide gap between the stripes, such as the gap that would be left if the wide side-runner were to lie between the stripes, would remain as a wide gap after compaction, which would be unacceptable.

Asphalt has the property of feathering itself well, when applied to an already-existing road surface. Therefore, even though the stripe may be laid with a nominal thickness of, say, 2 cm, the "step" at the edge of the stripe will quickly disappear. However, generally, the thickness of the as-laid stripe that lies nearer the centre of the road should not exceed about 4 cm, if it is to feather-itself into the road surface. Therefore, the right-side-runner generally will be set so as to lift the right side of the stripe-thickness-setting-blade more than the left-side-runner lifts the left side of the blade. Thus, the thickness H of the stripe is less on the right of the stripe than on the left.

It has been described that the weight of the asphalt-laden box is sufficient to keep the side-runners pressed firmly downwards. In a case where more down-force is required, the hydraulic ram 32 can be of the double-acting type, and can be pressurised to load the box downwards. However, this is not preferred, in that, apart from the extra complication, it would be difficult to ensure that the force from the ram would be spread evenly between the two side-runners.

If it is desired to utilise the apparatus in cases where only a narrow stripe is required, i.e a stripe that does not exceed the width of one of the tires 34*a*, the openable door 38 can be provided as two half-doors. Each half would be operated by its own ram.

What is now claimed is:

1. Apparatus for use in conjunction with a dump-truck;

the dump-truck being of the kind having a hopper for containing road-repair-materials, and a side-chute for discharging said materials, the side-chute being located at the side of the truck, and ahead of the rear wheels, wherein:

the apparatus comprises a means for laying a stripe of the repair material on the road surface, the stripe being positioned in line with a rear wheel of the truck, whereby the rear wheel rolls over the stripe, and compacts the material;

the apparatus includes a box, for containing the road-repair-material;

the apparatus includes a means for mounting and positioning the box on the truck under the side-chute, for receiving material from the side-chute;

the apparatus includes a laterally-extending stripe-thickness-setting blade;

the apparatus includes left and right side-runners, which are positioned in the apparatus adjacent to the left and right lateral ends of the blade, respectively;

in the apparatus, the side-runners comprise a means for supporting the weight of the box;

the apparatus includes a means for holding the stripe-thickness-setting-blade a height H clear of the road surface;

the box has a floor-surface, being the upward-facing surface against which rests the weight of the repair-material in the box;

the box is provided with a deposition-aperture, which is arranged in the apparatus for discharging material therethrough from the box onto the road surface;

the deposition-aperture occupies only a minor proportion of the floor-surface of the box, whereby most of the weight of the repair-material in the box acts on the box, weighting the box against the road surface;

in the apparatus, the deposition-aperture is positioned ahead of the blade, and the apparatus is so arranged that the blade passes over the material deposited from the aperture, and the thickness of the deposited stripe is defined by the height H at which the blade is held above the road surface.

2. Apparatus of claim 1, wherein the side-runners are so arranged in the apparatus as to contain the deposited material laterally, and thereby to define the width of the stripe.

3. Apparatus of claim 1, wherein the side-runners comprise the means for holding the stripe-thickness-setting-blade a height H clear of the road surface.

4. Apparatus of claim 1, wherein the box is so shaped as to define a bottom-edge of the box, and the stripe-thickness-setting-blade comprises the bottom-edge of the box.

5. Apparatus of claim 1, wherein the floor surface of the box is V-shaped.

6. Apparatus of claim 1, wherein the apparatus includes an operable means for opening and closing the deposition-aperture, comprising an operable door.

7. Apparatus of claim 1, wherein the apparatus includes a means for adjusting the height of the left and right side-runners relative to the stripe-thickness-setting blade.

8. Apparatus of claim 7, wherein the means for adjusting the height of the left and right side-runners relative to the stripe-thickness-setting blade is so arranged that the height of the left side-runner relative to the blade can be adjusted independently from the height of the right side runner relative to the blade.

9. Apparatus of claim 1, wherein one of the side runners is wide, and the other is narrow.

10. Apparatus of claim 1, wherein the apparatus includes an operable means for moving the box up and down, between an operational position and a stowage and transport position.

11. Apparatus of claim 10, wherein the operable means for moving the box up and down includes a parallelogram linkage, which is so arranged that the box remains upright when moving up and down.

12. Apparatus of claim 1, wherein the apparatus includes a means for pre-compacting the deposited repair-material, prior to the material being compacted beneath the rear wheel;

the means for pre-compacting the material comprises a laterally-extending pre-compacting member, which is so positioned that, in operation of the apparatus, the member lies behind the stripe-thickness-setting-blade;

the apparatus includes a means for holding the pre-compacting member a height C above the road surface, where the height C is smaller than the height H.

13. Apparatus of claim 12, wherein the pre-compacting member comprises a roller.

14. Apparatus of claim 12, wherein the truck is of the type that has two rear tires side-by-side, and a small gap therebetween, and the stripe is wider than the width of one of the tires.

15. Apparatus of claim 1, wherein the repair material is asphalt.

16. Apparatus of claim 1, wherein:

the side runners are so arranged in the apparatus as to contain the deposited material laterally, and thereby to define the width of the stripe;

the side runners comprise the means for holding the stripe-thickness-setting-blade a height H clear of the road surface;

the box is so shaped as to define a bottom-edge of the box, and the stripe-thickness-setting-blade comprises the bottom-edge of the box;

the floor surface of the box is V-shaped;

the apparatus includes an operable means for opening and closing the deposition-aperture, comprising an operable door;

the apparatus includes a means for adjusting the height of the left and right side-runners relative to the stripe-thickness-setting blade;

the means for adjusting the height of the left and right side-runners relative to the stripe-thickness-setting blade is so arranged that the height of the left side-runner relative to the blade can be adjusted independently from the height of the right side runner relative to the blade;

one of the side runners is wide, and the other is narrow;

the apparatus includes an operable means for moving the box up and down, between an operational position and a stowage and transport position;

the operable means for moving the box up and down includes a parallelogram linkage, which is so arranged that the box remains upright when moving up and down;

the apparatus includes a means for pre-compacting the deposited repair-material, prior to the material being compacted beneath the rear wheel;

the means for pre-compacting the material comprises a laterally-extending pre-compacting member, which is so positioned that, in operation of the apparatus, the member lies behind the stripe-thickness-setting-blade;

the apparatus includes a means for holding the pre-compacting member a height C above the road surface, where the height C is smaller than the height H;

the truck is of the type that has two rear tires side-by-side, and a small gap therebetween, and the stripe is wider than the width of one of the tires.

17. Apparatus of claim 1, in combination with a dump-truck, wherein:

the dump-truck includes a hopper for containing road-repair-materials, and a side-chute for discharging said materials, the side-chute being located at the side of the truck, and ahead of the rear wheels;

the apparatus comprises a means for laying a stripe of the repair material on the road surface, the stripe being positioned in line with a rear wheel of the truck, whereby the rear wheel rolls over the stripe, and compacts the material.

18. Apparatus of claim 10, wherein:

this means for moving the box up and down includes an operable powered-lift-means;

the powered-lift-means is so structured as to be capable of being power-operated to lift all portions of the apparatus clear of the ground, leaving no portion of the apparatus to be lifted, for transport, by means other than the powered-lift-means.

* * * * *